US009308747B2

(12) United States Patent
Winters et al.

(10) Patent No.: US 9,308,747 B2
(45) Date of Patent: Apr. 12, 2016

(54) PRINTER MECHANISM WITH SHAPE CONTROL MECHANISM TO TRANSFORM HILLS AND VALLEYS

(71) Applicant: Hewlett-Packard Development Company, L.P., Houston, TX (US)

(72) Inventors: William Winters, Vancouver, WA (US); Bruce G. Johnson, Vancouver, WA (US); Hugo S. Ortiz, Vancouver, WA (US); Justin M. Roman, Vancouver, WA (US); Alvin Marion Post, Vancouver, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 202 days.

(21) Appl. No.: 13/756,331

(22) Filed: Jan. 31, 2013

(65) Prior Publication Data

US 2014/0210923 A1 Jul. 31, 2014

(51) Int. Cl.

| | |
|---|---|
| ***B41J 2/01*** | (2006.01) |
| ***B41J 11/00*** | (2006.01) |
| ***B41J 11/06*** | (2006.01) |

(52) U.S. Cl.

CPC ..... *B41J 11/0005* (2013.01); *B41J 11/06* (2013.01)

(58) Field of Classification Search

CPC ..... B41J 11/0005; B41J 11/06
USPC ..... 347/8, 16, 104
See application file for complete search history.

(56) References Cited

U.S. PATENT DOCUMENTS

| | | | | |
|---|---|---|---|---|
| 5,393,151 | A | 2/1995 | Martin et al. | |
| 6,341,908 | B1 | 1/2002 | Johnson | |
| 6,478,490 | B2 | 11/2002 | Kelley et al. | |
| 6,572,292 | B2 | 6/2003 | Kelley et al. | |
| 6,585,439 | B2 | 7/2003 | Johnson et al. | |
| 6,666,602 | B2 | 12/2003 | Johnson | |
| 7,287,922 | B2 | 10/2007 | Buxton et al. | |
| 7,653,340 | B2 | 1/2010 | Shida et al. | |
| 7,955,013 | B2 | 6/2011 | Ortiz | |
| 8,087,773 | B2 | 1/2012 | Bober et al. | |
| 2005/0168557 | A1 * | 8/2005 | Ohyama | 347/104 |
| 2012/0062676 | A1 | 3/2012 | Mitsuya | |

OTHER PUBLICATIONS

Fricker, A.L. et al., "An Investigation Into the Effects of Solvent Content on the Image Quality and Stability of Ink Jet Digital Prints Under Varied Storage Conditions", IOP Science, 2010, 7 pgs., vol. 231; Issue: 1.

* cited by examiner

*Primary Examiner* — Henok Legesse
(74) *Attorney, Agent, or Firm* — Dicke, Billig & Czaja, PLLC

(57) ABSTRACT

A printer mechanism includes a printhead to print on a print medium, and a platen located generally adjacent the printhead such that the platen and the printhead define a print zone therebetween. The platen includes a plurality of elongate ribs that project from an upper surface of the platen in a spaced relationship and positioned to contact a lower surface of the print medium such that the print medium bends downwardly between the ribs to provide an undulated section of the print medium with hills and valleys in the print zone. At least one shape control mechanism transforms each of the hills in the print zone into a corresponding valley in an output path adjacent to the print zone and transforms each of the valleys in the print zone into a corresponding hill in the output path.

14 Claims, 4 Drawing Sheets

PRINTER MECHANISM WITH SHAPE CONTROL MECHANISM TO TRANSFORM HILLS AND VALLEYS

BACKGROUND

One of the challenges faced when printing on media is how to adequately control the shape of the sheet during and after printing. This becomes more challenging when the printing is done with volatile inks using carrier fluids such as water or alcohol. When the ink and carrier is deposited on the paper, the carrier is absorbed into the sheet causing the fibers in the sheet to expand (grow) causing cockle. This cockle growth changes the distance between the media and the pen in localized regions and can cause dot placement errors (image quality issues). If the cockle formation can be understood, manipulated, and controlled, the writing system can compensate for the dot placement error (sheet height variation) and maintain optimum image quality levels.

DETAILED DESCRIPTION

Figure 1:
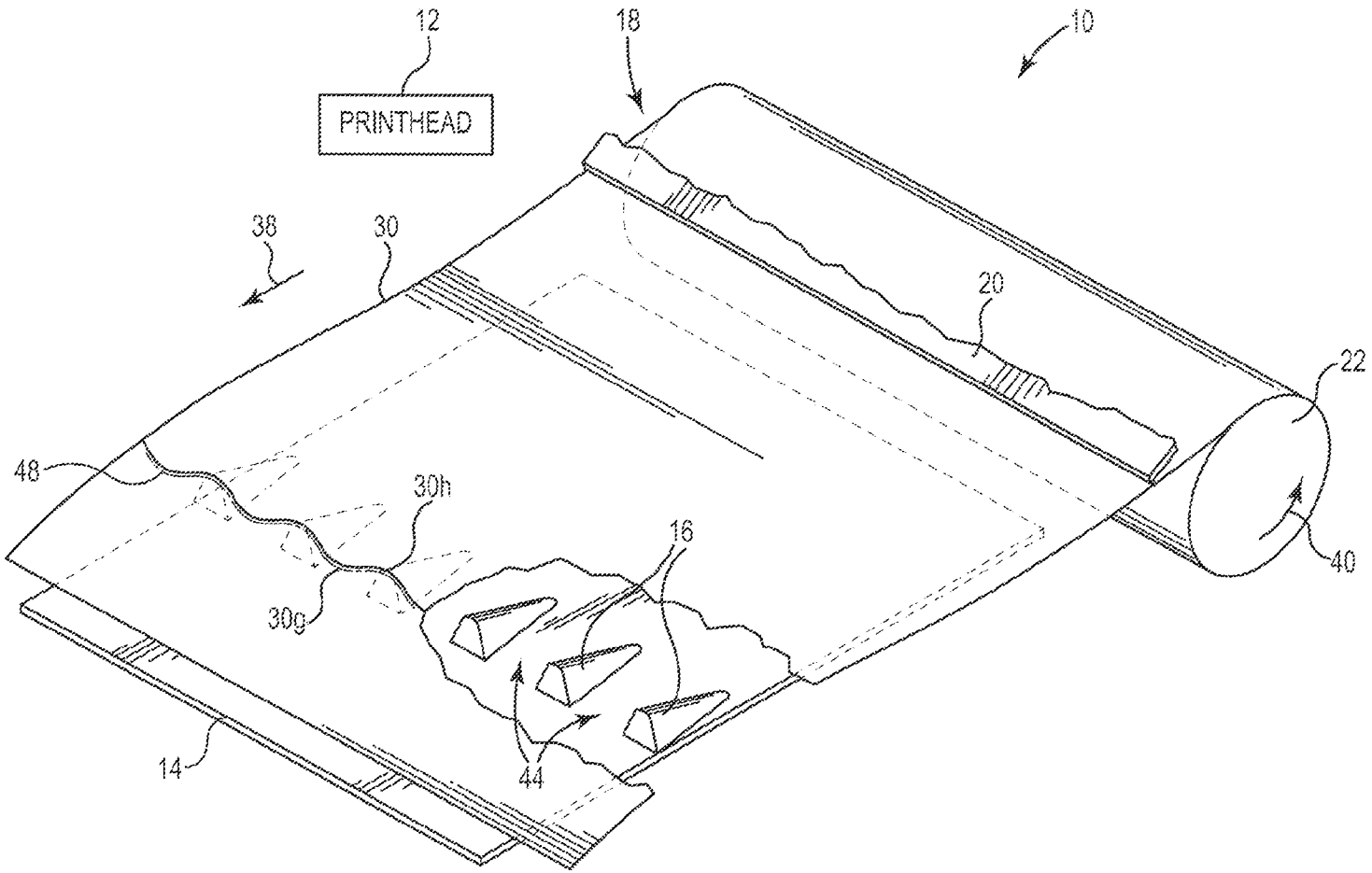
FIG. 1 is a diagram illustrating a print material handling system according to one implementation.

In the following detailed description, reference is made to the accompanying drawings which form a part hereof, and in which is shown by way of illustration specific embodiments in which the disclosure may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present disclosure. The following detailed description, therefore, is not to be taken in a limiting sense, and the scope of the present disclosure is defined by the appended claims. It is to be understood that features of the various embodiments described herein may be combined with each other, unless specifically noted otherwise.

Typically, ink-jet printers include a printhead for printing on a print medium, a print zone positioned adjacent the printhead, a feed mechanism for feeding a print medium through the print zone, and a platen positioned adjacent the print zone, the platen guiding and supporting the print medium in the print zone during printing. For ink-jet printers, the challenge of controlling the shape of the sheet during and after printing becomes more difficult as print zones become wider, and as the path becomes more complex. One factor that adds complexity is when the media changes direction after printing to facilitate output system requirements. When a sheet cockles from printing or is forced into an oscillating/sinusoidal shape due to platen rib design, the media becomes rigid in the direction perpendicular to the axis of the cockle. This rigidity makes the media difficult to control if an angular change in direction is performed to direct the media to an upward sloping output tray. Due to the stiffness of the media from the cockle, when the sheet is forced to bend to align with the output path, the sheet buckles in an uncontrolled manner. This can influence the paper shape in the print zone causing image quality defects in the print zone. One implementation allows for a much smoother and highly controlled transition between the print zone and the angled output path. This controlled transition translates into more uniform and predictable paper shape control and ultimately better image quality.

A dual reverse bow implementation can be used to help force the media into a desired shape. The dual reverse bow implementation is focused on storing sufficient energy in the sheet to control paper shape in a reliable direction away from the pen. In one form of the present disclosure, the physical control of paper shape is accomplished through a combination of the dual reverse bow and the use of additional control mechanisms. One additional control mechanism is the use of star wheels placed at key locations to influence the media to take the desired shape. Another additional control mechanism is the specific locations of the output rollers to allow the media to buckle in specific locations.

Specific implementations disclosed herein are different than prior solutions in that they are based on a recognition that there are natural shapes that the media wants to conform to when exiting the print zone and changing trajectory into the output path. One implementation uses a row of ceiling star wheels to change the peaks of the paper shape in the print zone into the valleys of the paper shape in the eject path. These valleys align with the gaps between the output rollers and thus define the position of the output cots.

Some implementations are directed to a system and method for controlling paper shape during printing and isolating post print output systems from causing print defects. One implementation is directed to mechanical components that effectively influence and control the paper shape including cockle formation to maintain optimum image quality through the print zone. In addition, implementations also isolates the post print output rollers and output geometry from influencing the paper shape in the print zone. In one implementation, this control is accomplished through a series of precisely placed star wheels and controlling paper shape through both the print zone and the output path into the output tray.

FIG. 1 is a diagram illustrating a print material handling system 10 according to one implementation. Print material handling system 10 includes a printhead 12 and a platen 14. The platen 14 includes ribs 16 on an upper surface thereof. Print material handling system 10 may also be referred to as a printer mechanism, a print medium handling device or a print medium handling mechanism. Printhead 12 may also be referred to as a pen or an ink-jet printhead. Platen 14 may also be referred to as a support structure. Platen 14 is positioned generally adjacent to printhead 12 such that a print zone is defined therebetween. System 10 further includes a feed device 18, which includes a paper guide 20 and a drive roller 22. The feed device 18 is typically positioned adjacent the printer input port or entrance region of the print zone. In operation, drive roller 22 feeds or advances a sheet of print material 30 in direction of travel 38 into the print zone. In one implementation, printhead 12 includes one or more nozzles, which together comprise a printing array. In operation, the nozzles drop or eject ink droplets onto an upper surface of the sheet 30 positioned adjacent printhead 12.

Sheet 30 further includes a lower surface that generally contacts a top surface of ribs 16. The ribs 16 contact the lower surface of the sheet 30 such that the sheet 30 bends downwardly between the ribs 16, thereby reducing uncontrolled bending of the sheet 30 in the print zone. Ribs 16 are spaced from one another thereby defining spaces 44 therebetween. Ribs 16 allow the print material 30 to bend downwardly between the ribs 16 into spaces 44 to inhibit uncontrolled bending of the print material 30 during printing. The sheet 30 bends downwardly, to form depressions 30*g*, between adjacent ribs 16. The highest point 30*h* of the wave-type bends of sheet 30 contact and are supported by the top surface of ribs 16. Ribs 16 extend generally parallel to a direction of travel 38 of print material 30.

In another way of describing the implementation, print medium handling device 10 comprises a pen 12 for printing on a print medium 30 and a support structure 14 located generally adjacent the pen 12 such that the print medium 30 is positioned between the pen 12 and the support structure 14 during printing. Support structure 14 includes upwardly extending projections 16 to support print medium 30 during printing.

Figure 2:
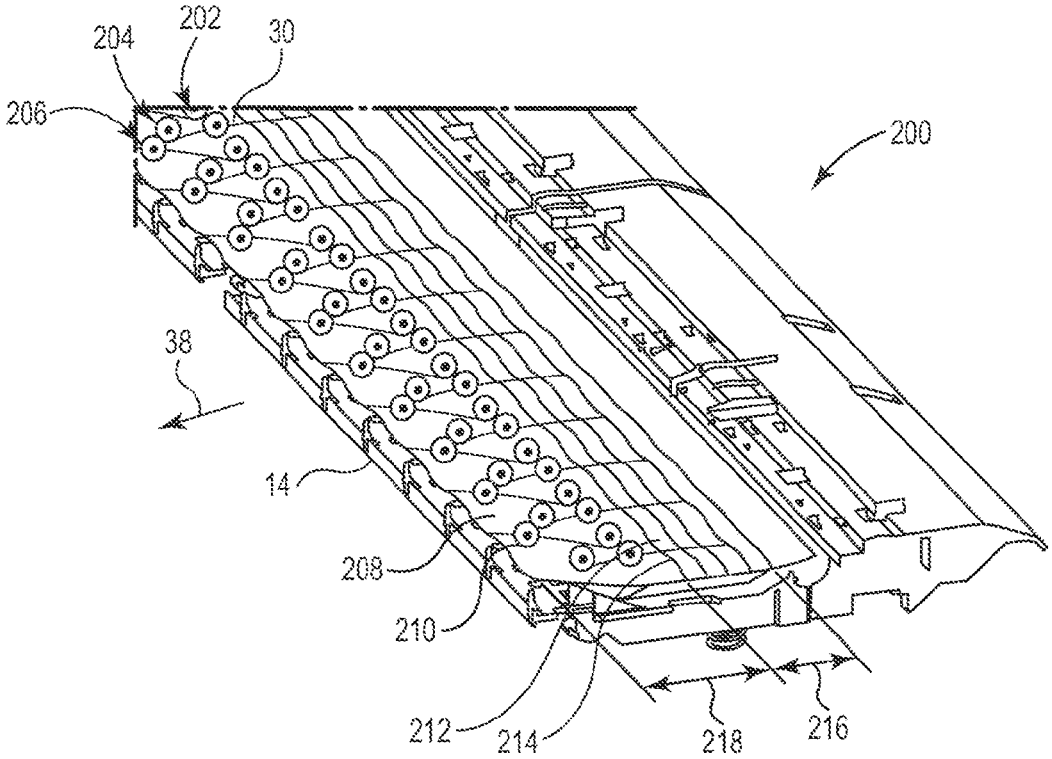
FIG. 2 is a diagram illustrating a print material handling system according to another implementation.

FIG. 2 is a diagram illustrating a print material handling system 200 according to another implementation. Print material handling system 200 includes a printhead 12 (FIG. 1) and a platen 14. The platen 14 includes ribs 16 (FIG. 1) on an upper surface thereof. The ribs 16 are not visible in FIG. 2 because they are covered by a sheet 30 of print material. Print material handling system 10 may also be referred to as a printer mechanism, a print medium handling device or a print medium handling mechanism. Printhead 12 may also be referred to as a pen or an ink-jet printhead. Platen 14 may also be referred to as a support structure.

The sheet 30 is advanced in direction of travel 38 through the print zone 216 and then into the output path 218. The output path 218 is angled upward with respect to the print zone 216. In one implementation, the output path 218 is sloped upward with respect to the print zone 216 at an angle of about ten degrees. In one implementation, handling system 200 handles wide format sheets of print material (e.g., at least 11 inches wide).

The lower surface of sheet 30 contacts a top surface of ribs 16. The ribs 16 contact the lower surface of the sheet 30 such that the sheet 30 bends downwardly between the ribs 16 to form valleys 212 between adjacent ribs 16. The ribs 16 form hills 214, with the highest point or peak of each hill 214 being in contact with and supported by the top surface of a corresponding one of the ribs 16. In one implementation, ribs 16 include major ribs that have a first height, and minor ribs that have a second height that is smaller than the first height. In one form of this implementation, the ribs 16 alternate between major ribs and minor ribs such that each adjacent pair of major ribs is separated by a minor rib and each adjacent pair of minor ribs is separated by a major rib. The major ribs are the tallest ribs and define the Pen to Rib Spacing (PRS). In a specific implementation, the minor ribs are 2 mm lower than the major ribs and serve as a lower floor for the paper valleys 212.

System 200 includes a first row of star wheels 202, a second row of star wheels 204, and a third row of star wheels 206. In one implementation, the three rows of star wheels 202, 204, and 206 are implemented on a star wheel hanger that hangs over the platen 14. The direction of travel 38 of sheet 30 represents a longitudinal direction, and the direction perpendicular to the direction of travel 38 represents a lateral direction. The first, second, and third rows of star wheels 202, 204, and 206 are longitudinally offset from each other. The first row of star wheels 202 is positioned closest to the print zone 216, and the third row of star wheels 206 is positioned farthest away from the print zone 216. The second row of star wheels 204 is positioned between the first row 202 and the third row 206. The star wheels in the first row 202 are longitudinally aligned with each other and laterally offset from each other. The star wheels in the second row 204 are longitudinally aligned with each other and laterally offset from each other. The star wheels in the third row 206 are longitudinally aligned with each other and laterally offset from each other.

Each of the hills 214 formed in the sheet 30 by the ribs 16 extends longitudinally along the sheet 30, and the hills 214 are laterally offset from one another. Each of the valleys 212 formed in the sheet 30 by the ribs 16 extends longitudinally along the sheet 30, and the valleys 212 are laterally offset from one another and laterally offset from the hills 214. The hills 214 and the valleys 212 form an alternating pattern, with each adjacent pair of the hills 214 being laterally separated from each other by one of the valleys 212, and with each adjacent pair of the valleys 212 being laterally separated from each other by one of the hills 214.

The first row of star wheels 202 includes a first set of star wheels, with each star wheel in the first set being laterally aligned with one of the hills 214. The first row of star wheels 202 also includes a second set of star wheels, with each star wheel in the second set being laterally aligned with one of the valleys 212. The star wheels in the first set of the first row 202 are vertically offset (e.g., by 1.0 mm) from the star wheels in the second set of the first row 202, such that the star wheels in the second set are positioned closer to the platen 14 than the star wheels in the first set. The first row of star wheels 202 keeps the leading edge curl from lifting the sheet 30 in the print zone 216, which can cause image quality defects.

Figure 3:
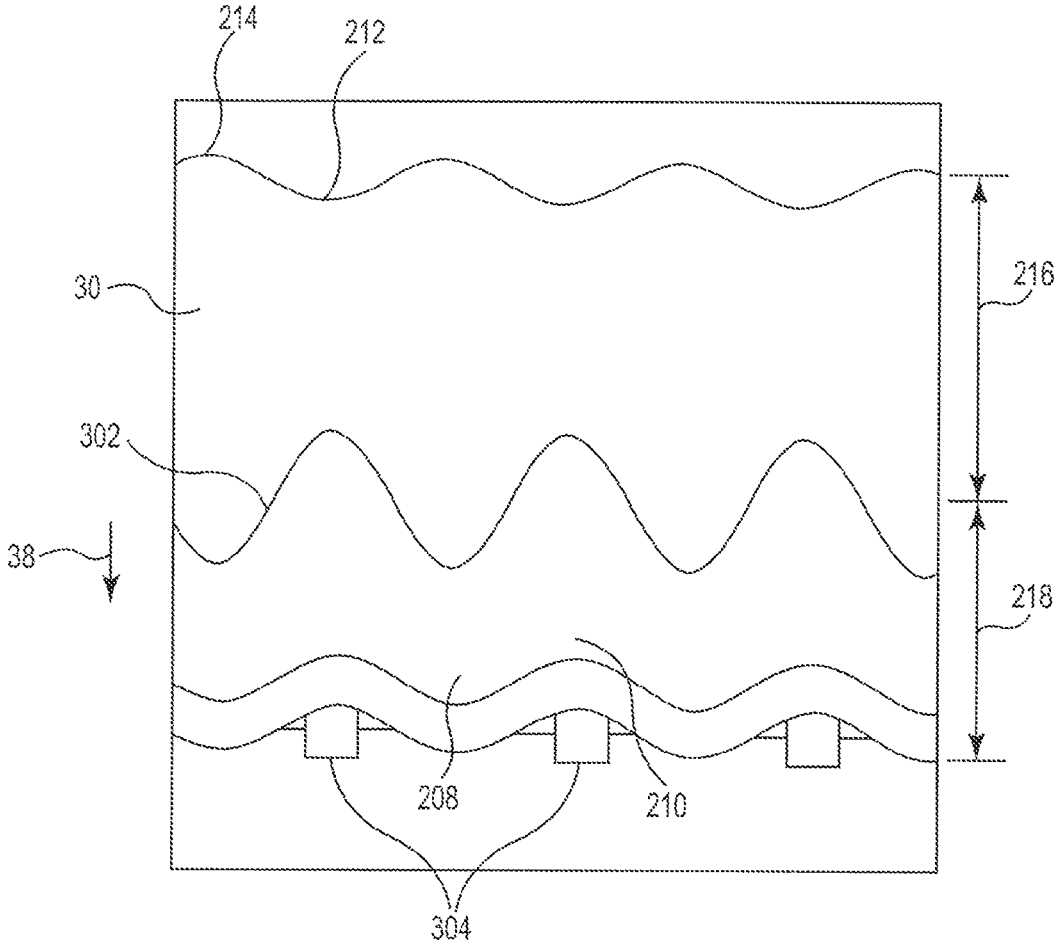
FIG. 3 is a diagram illustrating output rollers of the print material handling system shown in FIG. 2 according to one implementation.

Each star wheel in the second row 204 is laterally aligned with one of the hills 214 and correspondingly with one of the ribs 16. The second row of star wheels 204 influences the sheet 30 to take its natural stable shape during the transition from the print zone 216 to the output path 218 and the output rollers 304 (FIG. 3). The second row of star wheels 204 keeps the sheet 30 from buckling upward, and helps guide the formation of the valleys 208 at the output path 218.

Each star wheel in the third row 206 is laterally aligned with a corresponding one of the valleys 212 and is laterally and longitudinally aligned with a corresponding one of the rollers 304 (FIG. 3). The third row of star wheels 206 provide a pinch force with the output rollers 304 (FIG. 3) to eject the sheet 30.

FIG. 3 is a diagram illustrating output rollers 304 of the print material handling system 200 shown in FIG. 2 according to one implementation. As shown in FIG. 3, each of the output rollers 304 is laterally aligned with one of the valleys 212, and the output rollers 304 are laterally offset from the hills 214. Since the hills 214 correspond to the position of the ribs 16 (or the major ribs if both major ribs and minor ribs are used), the output rollers 304 are laterally offset from the ribs 16. Positioning of the output rollers 304 between the major ribs allows the sheet 30 to buckle down into valleys 208 between the output rollers 304.

The output rollers 304 could be positioned in line with the major platen ribs (i.e., the ribs that control pen-to-paper spacing). However, analysis of paper shape in the transition between the print zone 216 and the output rollers 304 demonstrated that the sheet 30 was not stable and thus uncontrollable in this transition. It was determined that, in order to have a stable and controllable paper shape, the hills 214 of the sheet 30 in the print zone 216 should become the valleys 208 after the angular transition (indicated at 302) into the output path 218, and that the valleys 212 in the print zone 216 should become the hills 210 at the output path 218. If this did not occur, the buckling of the sheet 30 in this transition could reflect into the print zone 216 and cause image quality defects such as smearing. In order to accomplish this stable shape, the second row of star wheels 204 (FIG. 2) is used to influence the sheet 30 to buckle downward (become a valley 208), and the output rollers 304 are positioned between the ribs 16 to allow the sheet 30 to buckle down into a gap between the rollers 304. Thus, as the sheet 30 is moved in the direction of travel 38, each of the hills 214 in the print zone 216 is transformed into a corresponding valley 208 in the output path 218, and each of the valleys 212 in the print zone 216 is transformed into a corresponding hill 210 in the output path 218.

Figure 4:
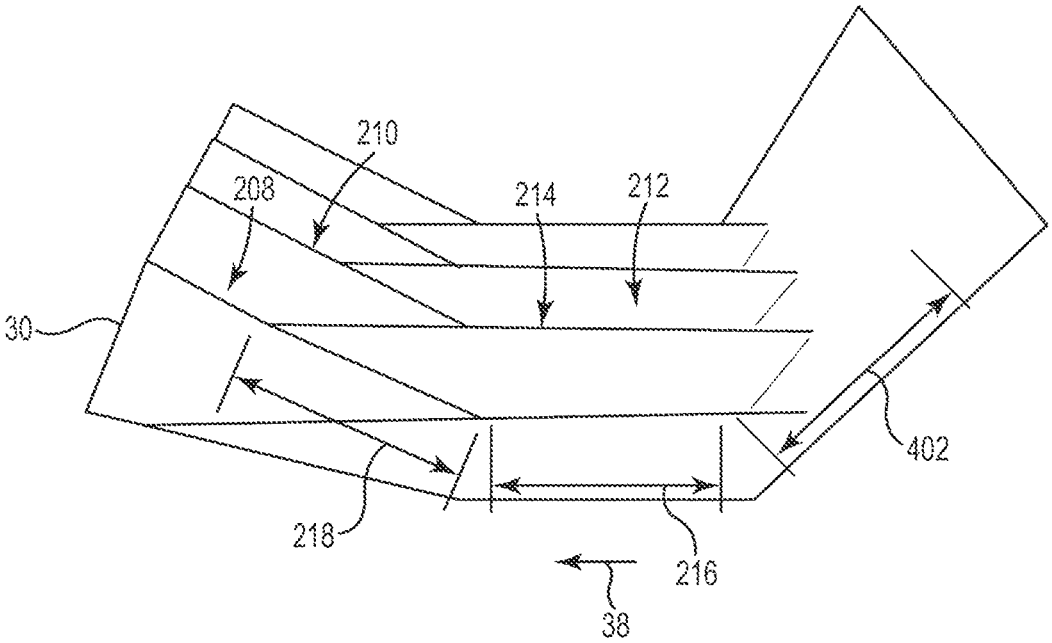
FIG. 4 is a diagram illustrating a sheet of print material that has a shape produced by the print material handling system shown in FIG. 2 according to one implementation.

FIG. 4 is a diagram illustrating a sheet of print material 30 that has a shape produced by the print material handling system 200 according to one implementation. As shown in FIG. 4, the portion of the sheet 30 that is in the output path 218 at any given time is angled upward with respect to the portion of the sheet 30 that is in the print zone 216 at that time. Similarly, the portion of the sheet 30 that is in the pre-print zone 402 at any given time is also angled upward with respect to the portion of the sheet 30 that is in the print zone 216 at that time. Thus, as sheet 30 is moved through the handling system 200 (moved right to left in FIG. 4), the leading edge of the sheet 30 first moves in a downward direction through the pre-print zone 402, then moves in a substantially horizontal direction through the print zone 216, and then moves in an upward direction through the output path 218.

The portion of the sheet 30 in the print zone 216 includes hills 214 and valleys 212. Each of the hills 214 extends longitudinally along the sheet 30, and the hills 214 are laterally offset from one another. Each of the valleys 212 formed in the sheet 30 extends longitudinally along the sheet 30, and the valleys 212 are laterally offset from one another and laterally offset from the hills 214. The hills 214 and the valleys 212 form an alternating pattern, with each adjacent pair of the hills 214 being laterally separated from each other by one of the valleys 212, and with each adjacent pair of the valleys 212 being laterally separated from each other by one of the hills 214.

The portion of the sheet 30 in the output path 218 includes hills 210 and valleys 208. Each of the hills 210 extends longitudinally along the sheet 30, and the hills 210 are laterally offset from one another. Each of the valleys 208 formed in the sheet 30 extends longitudinally along the sheet 30, and the valleys 208 are laterally offset from one another and laterally offset from the hills 210. The hills 210 and the valleys 208 form an alternating pattern, with each adjacent pair of the hills 210 being laterally separated from each other by one of the valleys 208, and with each adjacent pair of the valleys 208 being laterally separated from each other by one of the hills 210. As the sheet 30 is moved in the direction of travel 38, each of the hills 214 in the print zone 216 is transformed into a corresponding valley 208 in the output path 218, and each of the valleys 212 in the print zone 216 is transformed into a corresponding hill 210 in the output path 218.

One implementation is directed to a printer mechanism including a printhead to print on a print medium, and a platen located generally adjacent the printhead such that the platen and the printhead define a print zone therebetween. The platen includes a plurality of elongate ribs that project from an upper surface of the platen in a spaced relationship and positioned to contact a lower surface of the print medium such that the print medium bends downwardly between the ribs to provide an undulated section of the print medium with hills and valleys in the print zone. The printer mechanism includes at least one shape control mechanism to transform each of the hills in the print zone into a corresponding valley in an output path adjacent to the print zone and transform each of the valleys in the print zone into a corresponding hill in the output path.

In one implementation, each rib extends substantially parallel to a direction of travel of the print medium through the print zone, and the direction of travel defines a longitudinal dimension. The at least one shape control mechanism includes a first row of star wheels including a first set of star wheels, and each star wheel in the first set is laterally aligned with one of the hills. The first row of star wheels includes a second set of star wheels, and each star wheel in the second is laterally aligned with one of the valleys in the print zone. The star wheels in the first set of the first row are vertically offset from the star wheels in the second set of the first row, such that the star wheels in the second set are positioned closer to the platen than the star wheels in the first set. In one form of this implementation, the at least one shape control mechanism includes a second row of star wheels, and each star wheel in the second row is laterally aligned with one of the hills in the print zone. The second row of star wheels facilitates the transforming of each of the hills in the print zone into a corresponding valley in the output path. In another form of this implementation, the at least one shape control mechanism includes a third row of star wheels, and each star wheel in the third row is laterally aligned with a corresponding one of the valleys in the print zone. In another form of this implementation, the at least one shape control mechanism includes a plurality of output rollers, and the output rollers and the third row of star wheels provide a pinch force on the print medium. Each of the star wheels in the third row is laterally and longitudinally aligned with a corresponding one of the output rollers. In one implementation, the output path is angled upward with respect to the print zone at an angle of about ten degrees. The print medium according to one implementation is at least about 11 inches wide.

Another implementation is directed to a print medium handling device for a printer, which includes a pen to print on a print medium, and a support structure located adjacent the pen such that print medium is positioned between the pen and the support structure during printing. The support structure includes multiple upwardly extending spaced projections to provide an undulated section of the print medium with hills and valleys in a print zone of the handling device. The handling device includes at least one shape control mechanism to transform each of the hills in the print zone into a corresponding valley in an output path adjacent to the print zone and transform each of the valleys in the print zone into a corresponding hill in the output path.

Yet another implementation is directed to a print medium handling mechanism for a printer having an ink-jet printhead, which includes a printhead to print on a print medium, and a support surface located adjacent the printhead. The support surface includes fixed projections. Each of the projections extends substantially parallel to a direction of travel of the print medium and causes hills and valleys to be formed in the print medium in a print zone. The direction of travel defines a longitudinal dimension. The handling mechanism includes at least one paper shape control mechanism including a plurality of rows of star wheels to transform each of the hills in the print zone into a corresponding valley in an output path adjacent to the print zone and transform each of the valleys in the print zone into a corresponding hill in the output path.

Advantages provided by implementations disclosed herein include a very highly controlled and stable paper shape in the print zone, and a substantial reduction in top of form smears and middle of page random smears.

Although specific embodiments have been illustrated and described herein, it will be appreciated by those of ordinary skill in the art that a variety of alternate and/or equivalent implementations may be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

What is claimed is:

1. A printer mechanism, comprising:

a printhead to print on a print medium;

a platen located generally adjacent the printhead such that the platen and the printhead define a print zone therebetween, the platen including a plurality of elongate ribs that project from an upper surface of the platen in a spaced relationship and positioned to contact a lower surface of the print medium such that the print medium bends downwardly between the ribs to provide an undulated section of the print medium with hills and valleys in the print zone; and at least one shape control mechanism to transform each of the hills in the print zone into a corresponding valley in an output path adjacent to the print zone and transform each of the valleys in the print zone into a corresponding hill in the output path, and wherein the at least one shape control mechanism includes a first row of star wheels including a first set of star wheels pressing down the upper surface of the print medium, and wherein each star wheel in the first set is laterally aligned with one of the hills in the print zone.

2. The printer mechanism of claim 1, wherein each rib extends substantially parallel to a direction of travel of the print medium through the print zone, and wherein the direction of travel defines a longitudinal dimension.

3. The printer mechanism of claim 2, wherein the first row of star wheels includes a second set of star wheels, and wherein each star wheel in the second is laterally aligned with one of the valleys in the print zone.

4. The printer mechanism of claim 3, wherein the star wheels in the first set of the first row are vertically offset from the star wheels in the second set of the first row, such that the star wheels in the second set are positioned closer to the platen than the star wheels in the first set.

5. The printer mechanism of claim 2, wherein the at least one shape control mechanism includes a second row of star wheels, and wherein each star wheel in the second row is laterally aligned with one of the hills in the print zone.

6. The printer mechanism of claim 5, wherein the second row of star wheels facilitates the transforming of each of the hills in the print zone into a corresponding valley in the output path.

7. The printer mechanism of claim 5, wherein the at least one shape control mechanism includes a third row of star wheels, and wherein each star wheel in the third row is laterally aligned with a corresponding one of the valleys in the print zone.

8. The printer mechanism of claim 7, wherein the at least one shape control mechanism includes a plurality of output rollers, and wherein the output rollers and the third row of star wheels provide a pinch force on the print medium.

9. The printer mechanism of claim 8, wherein each of the star wheels in the third row is laterally and longitudinally aligned with a corresponding one of the output rollers.

10. The printer mechanism of claim 1, wherein the output path is angled upward with respect to the print zone.

11. The printer mechanism of claim 10, wherein the output path is angled upward at an angle of about ten degrees.

12. The printer mechanism of claim 1, wherein the print medium is at least 11 inches wide.

13. A print medium handling device for a printer, the device comprising:

a pen to print on a print medium;

a support structure located adjacent the pen such that print medium is positioned between the pen and the support structure during printing, the support structure including multiple upwardly extending spaced projections to provide an undulated section of the print medium with hills and valleys in a print zone of the handling device; and at least one shape control mechanism to transform each of the hills in the print zone into a corresponding valley in an output path adjacent to the print zone and transform each of the valleys in the print zone into a corresponding hill in the output path, and wherein the at least one shape control mechanism includes a first row of star wheels including a first set of star wheels pressing down the upper surface of the print medium, and wherein each star wheel in the first set is laterally aligned with one of the hills in the print zone.

14. A print medium handling mechanism for a printer having an ink-jet printhead, the mechanism comprising:

a printhead to print on a print medium;

a support surface located adjacent the printhead, the support surface including fixed projections, each of the projections extending substantially parallel to a direction of travel of the print medium and causes hills and valleys to be formed in the print medium in a print zone, and wherein the direction of travel defines a longitudinal dimension; and at least one paper shape control mechanism including a plurality of rows of star wheels to transform each of the hills in the print zone into a corresponding valley in an output path adjacent to the print zone and transform each of the valleys in the print zone into a corresponding hill in the output path, and wherein the plurality of rows of star wheels presses down the upper surface of the print medium.

* * * * *